United States Patent [19]

Butler

[11] 4,229,160

[45] Oct. 21, 1980

[54] BUNSEN BURNER GUARD

[76] Inventor: William E. Butler, 401 E. 10th, Eugene, Oreg. 97401

[21] Appl. No.: 961,975

[22] Filed: Nov. 20, 1978

Related U.S. Application Data

[63] Continuation of Ser. No. 80,549, May 31, 1977, abandoned.

[51] Int. Cl.[3] ..... F23D 13/40

[52] U.S. Cl. ..... 431/355; 431/350

[58] Field of Search ..... 431/350, 355, 347; 362/266, 277, 317, 319, 322

[56] References Cited

U.S. PATENT DOCUMENTS

| | | | |
|---|---|---|---|
| 231,602 | 8/1880 | Meigs | 362/322 |
| 241,649 | 5/1881 | Haley | 362/322 |
| 470,603 | 3/1892 | Schloerb | 362/322 |
| 493,284 | 3/1893 | Nevins | 362/322 |
| 682,602 | 9/1901 | Conde | 362/322 |
| 1,143,650 | 6/1915 | Schribner | 362/266 |
| 1,186,323 | 6/1916 | Matisse et al. | 362/277 |

OTHER PUBLICATIONS

Chemical Engineers' Handbook—John H. Perry—4th Edition—McGraw-Hill Book Co., 1963, pp. 10–44 & 10–45.

*Primary Examiner*—Carroll B. Dority, Jr.
*Attorney, Agent, or Firm*—Klarquist, Sparkman, Campbell, Leigh, Hall & Whinston

[57] ABSTRACT

The specification discloses a bunsen burner guard formed by an arcuate, black shield mounted on the burner by a generally U-shaped clip in a position enabling the flame of the burner to be seen. The shield is of aircraft aluminum and is riveted to the clip. Aligned tabs are pushed out of the clip and the shield to lock the clip and the shield rigidly together.

7 Claims, 4 Drawing Figures

BUNSEN BURNER GUARD

This is a continuation of application Ser. No. 801,549, filed May 31, 1977, and now abandoned.

DESCRIPTION

This invention relates to an improved bunsen burner guard, and has for an object thereof the provision of a new and improved bunsen burner guard.

Another object of the invention is to provide a bunsen burner guard that makes the flame tip highly visible.

A further object of the invention is to provide a bunsen burner guard having a black shield carried by a clip riveted to and keyed to the shield.

Another object of the invention is to provide a bunsen burner guard including a generally U-shaped clip adapted to grip a tube of a burner and riveted to a black shield aligned tabs being pressed out of the clip and the shield to key them together.

Figure 1:
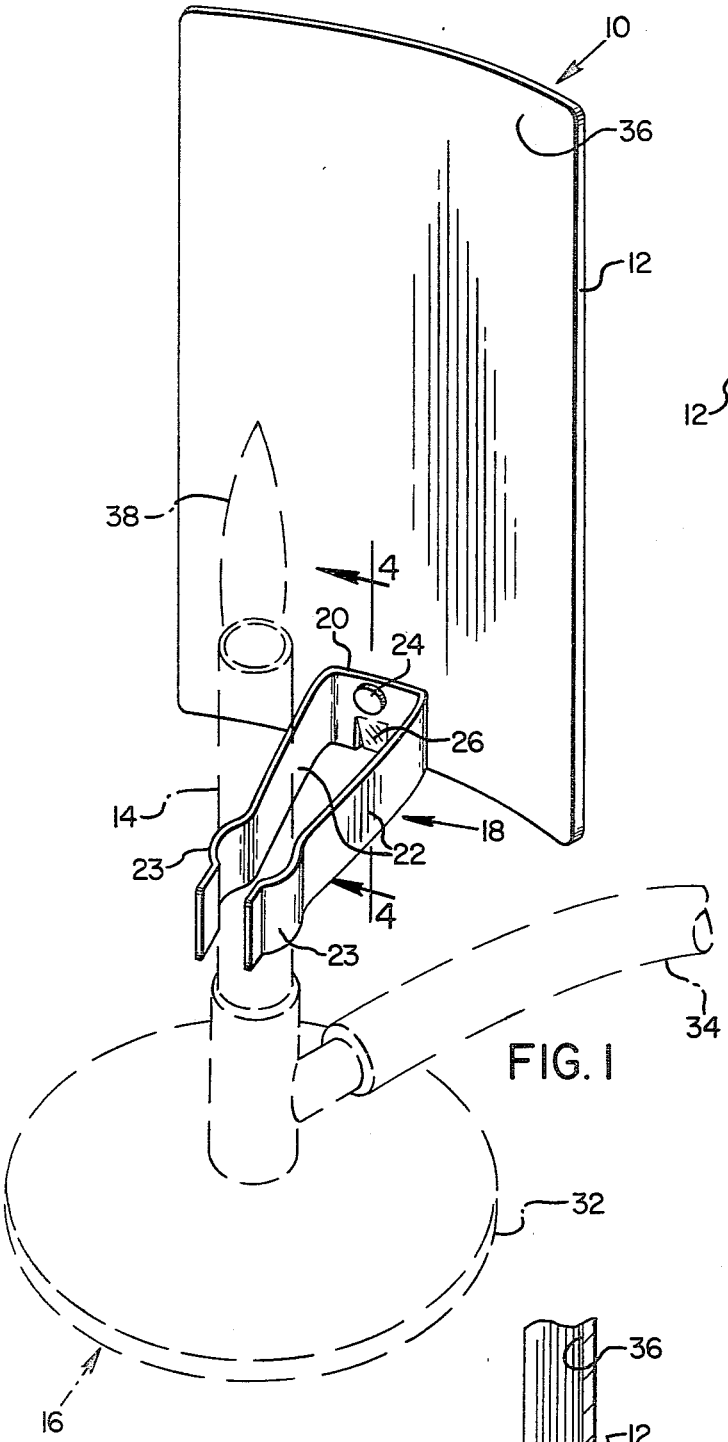
FIG. 1 is a perspective view of a guard forming one embodiment of the invention mounted on a burner.
Figure 2:
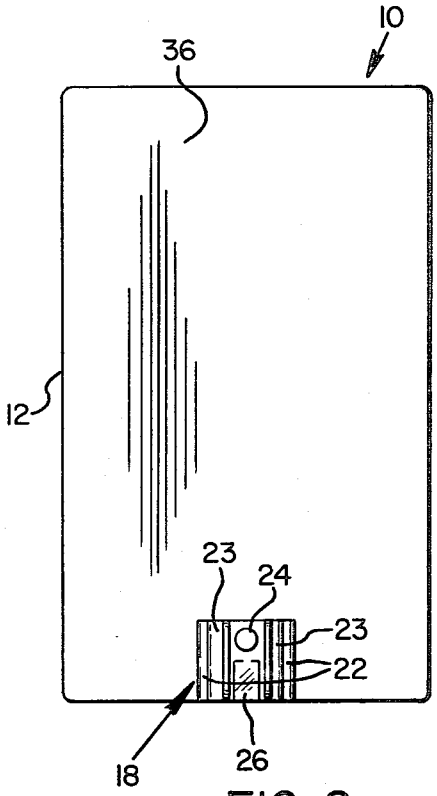
FIG. 2 is a reduced front elevation view of the guard of FIG. 1.
Figure 3:
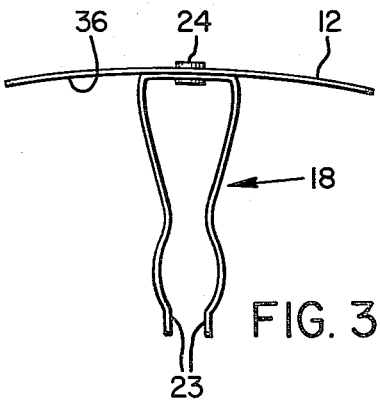
FIG. 3 is a reduced top plan view of the guard of FIG. 1.
Figure 4:
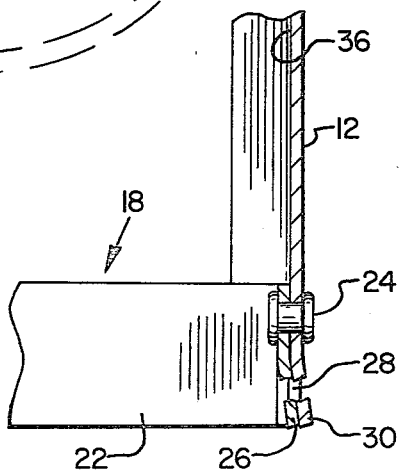
FIG. 4 is a fragmentary vertical sectional view taken along line 4–4 of FIG. 1.

An improved bunsen burner guard 10 forming a specific embodiment of the invention includes an arcuate shield 12 detachably mounted on an upright burner tube 14 of a bunsen burner 16 by a generally U-shaped mounting arm or clip 18. The clip has a planar base 20 and two spring arms 22 having opposed, arcuate gripping portions 23. A rivet 24 holds the shield tightly against the base 20, and a keying tab 26 cut from and bent partly out of the base fits closely into a notch 28 in the bottom portion of the shield. The tab 26 also presses against a tab 30 of the shield which is cut from and bent partly out of the shield. The tab 26 fits into the notch 28 to key the shield rigidly to the base. The tabs can be punched and bent separately before riveting, or both the tabs can be cut simultaneously by a punch press after the base and the shield have been secured together by the rivet 24. The burner may be any of types commonly used, and has a base 32, and is supplied with combustible gas by a hose 34.

The shield 12 has its inner face 36 of a dark, non-reflective color, preferably black. The shield preferably is of aircraft aluminum anodized flat black. The clip 18 is of spring metal, preferably also of aircraft aluminum. The portions 23 preferably are so spaced from the base 20 as to position the arcuate face 36 concentrically to the tube 14. The black face 36 silhouettes flame 38 of the burner so that the flame is highly visible. Thus, a user can readily see all of the flame which is light blue to increase efficiency and virtually eliminate accidental burns.

What is claimed is:

1. In combination with a bunsen burner, a bunsen burner guard comprising:

an elongated clip mounting member having an arcuate fastening portion grasping said burner, and an arcuate, black, non-reflective shield supported by the member concentrically relative to the arcuate portion, the mounting member comprising an arm.

2. The guard of claim 1 wherein the mounting member comprises a generally U-shaped clip.

3. The guard of claim 2 including pin-like fastener means holding the clip and the shield together and keying means offset from the pin means for preventing turning of the clip relative to the shield.

4. The guard of claim 3 wherein the keying means includes a key portion pressed out of the clip and a recess portion pressed into the shield and receiving the key portion.

5. The guard of claim 4 wherein the key portion is a tab cut from an edge portion of the clip.

6. The guard of claim 5 wherein the recess portion is a cut out portion on the lower edge portion of the shield formed by cutting a second tab substantially like the first mentioned tab.

7. The guard of claim 3 wherein the shield is of aircraft aluminum having a flat black anodized surface.

* * * * *